US008316546B2

(12) United States Patent
Oh

(10) Patent No.: US 8,316,546 B2
(45) Date of Patent: Nov. 27, 2012

(54) INSERT TYPE BLADE ASSEMBLY OF ROTATION DRUM TYPE ELECTRIC RAZOR

(76) Inventor: Tae-jun Oh, Namyangju-si (KR)

( * ) Notice: Subject to any disclaimer, the term of this patent is extended or adjusted under 35 U.S.C. 154(b) by 303 days.

(21) Appl. No.: 12/788,969

(22) Filed: May 27, 2010

(65) Prior Publication Data

US 2010/0299929 A1 Dec. 2, 2010

(30) Foreign Application Priority Data

May 28, 2009 (KR) ..... 20-2009-0006486 U

(51) Int. Cl.
*B26B 19/16* (2006.01)

(52) U.S. Cl. ..... 30/43.6; 30/346.51

(58) Field of Classification Search ..... 30/43.4, 30/43.5, 43.6, 346.51
See application file for complete search history.

(56) References Cited

U.S. PATENT DOCUMENTS

| | | | | |
|---|---|---|---|---|
| 2,331,873 | A | 10/1943 | Thews | |
| 2,416,776 | A | 3/1947 | Schlotthauer | |
| 3,128,550 | A * | 4/1964 | Miselli | 30/43.6 |
| 3,494,031 | A * | 2/1970 | Sklenar | 30/43.6 |
| 3,675,324 | A | 7/1972 | Yamada et al. | |
| 3,710,442 | A * | 1/1973 | Meyer | 30/43.6 |
| 4,031,618 | A * | 6/1977 | Mansfield | 30/41.5 |
| 4,043,036 | A * | 8/1977 | Stevens et al. | 30/43.6 |
| 4,811,483 | A * | 3/1989 | Bakker et al. | 30/43.6 |
| 4,827,613 | A * | 5/1989 | Bakker | 30/43.6 |
| 4,985,999 | A * | 1/1991 | Iwasaki et al. | 30/206 |
| 5,014,428 | A * | 5/1991 | Yamashita | 30/43.6 |
| 5,197,196 | A * | 3/1993 | Imagawa et al. | 30/346.51 |
| 5,745,995 | A * | 5/1998 | Yamashita et al. | 30/43.6 |
| 7,503,118 | B2 * | 3/2009 | Oh | 30/43.1 |
| 2002/0083592 | A1 * | 7/2002 | Liao | 30/43.92 |
| 2006/0085983 | A1 * | 4/2006 | Oh | 30/43.1 |
| 2006/0218793 | A1 * | 10/2006 | Zucker | 30/43.4 |
| 2007/0233160 | A1 * | 10/2007 | Oh | 606/133 |
| 2008/0060202 | A1 * | 3/2008 | Oh | 30/43.6 |
| 2010/0299929 | A1 * | 12/2010 | Oh | 30/43.6 |

FOREIGN PATENT DOCUMENTS

| | | | |
|---|---|---|---|
| EP | 1 900 487 | * | 3/2008 |
| GB | 2160462 | | 12/1985 |
| JP | S27-125782 | A | 8/1982 |
| JP | 2-131793 | * | 5/1990 |
| JP | H03-251282 | A | 11/1991 |
| JP | H08-038751 | A | 2/1996 |
| WO | WO 2005/118235 | * | 12/2005 |
| WO | WO 2008/152590 | | 12/2008 |

OTHER PUBLICATIONS

European Search Report for corresponding European Patent Application No. 09252800.9-2313 mailed Apr. 15, 2010.

* cited by examiner

*Primary Examiner* — Hwei C Payer
(74) *Attorney, Agent, or Firm* — Swanson & Bratschun LLC

(57) ABSTRACT

A rotation drum type electric razor which includes a blade assembly (40) including a rotational shaft (100) which extends in a lengthwise direction; a plurality of rotational blade members (200) which are respectively formed into a cylindrical waterwheel shape having a plurality of blades (220) coupled to the rotational shaft (100) and in which a coupling protrusion (230) is formed at each end of the blades (220), and the blades (220) are fitted in turn to the rotational shaft (100) in the form of a zigzag shape.

3 Claims, 8 Drawing Sheets

INSERT TYPE BLADE ASSEMBLY OF ROTATION DRUM TYPE ELECTRIC RAZOR

CROSS-REFERENCE(S) TO RELATED APPLICATIONS

The present invention claims priority of Korean Utility Model Application No. 20-2009-0006486, filed on May 28, 2009, which is incorporated herein by reference.

TECHNICAL FIELD

The present invention relates to an insert type blade assembly of a rotation drum type electric razor and, more particularly, to an insert type blade assembly of a rotation drum type electric razor, in which, when forming the blade assembly of the rotation drum type electric razor, a blade is mass-produced by press-cutting and shape-forming processes so that each of the blades is stacked in an insert type on a rotational shaft, thereby minimizing a space between the blades, and thus it is possible to minimize a protective screen from being dented into a space between the adjacent blades on the circumference by user's external force, thereby preventing interference between the blades and the protective screen, and it is also possible to facilitate clean shaving with high-speed rotating blade, and further a plurality of blades are provided in the insert type on a shaft axis, and thus it is simple to assemble or disassemble the blade assembly upon damage of the blades.

BACKGROUND OF THE INVENTION

In general, a blade assembly of a rotation drum type electric razor includes a main body, a motor which is disposed on a center axis of the main body, and a power transmission mechanism which transmits rotational force of the motor to a driving shaft of the blade assembly. A cover having a protective screen is provided at an upper side of the blade assembly.

In a conventional blade assembly 1, as shown in FIG. 1, a plurality of blade lines 3 are spirally formed on an outer surface of a cylindrical body 2 formed of a metal material, such that a shaving operation is carried out at a space between the blade line 3 and the protective screen.

A driving shaft 4 is inserted into a center portion of the cylindrical body 2, and a driven gear is provided at both ends of the driving shaft 4 so as to receive driving power from a power transmission mechanism. The blade line 3 is integrally formed with the surface of the metallic cylindrical body 2 formed by an insert injection molding method, and a separate metallic SUS blade is installed on the outer surface of the cylindrical body 2 so as to perform the shaving operation along with the blade line 3.

In the conventional blade assembly of the rotation drum type electric razor, the blade line is integrally formed on the outer surface of the cylindrical body formed by the insert injection molding method so as to perform the shaving operation together with the separate SUS blade. However, since there is not provided a cutting angle, cutting efficiency is deteriorated. Further, since the blade line has a short length, a cut beard is caught between the blade lines.

Furthermore, since the conventional rotation drum type electric razor is provided with only one cylindrical blade assembly, and body hair is cut only at an uppermost point of the cylindrical blade assembly, the ability of cutting the body hair is lowered. And also in order to carry out the clean shaving operation, it is necessary to repeatedly perform a serial process of contacting the uppermost point of the cylindrical blade assembly with a portion to be shaven and then cutting the body hair, and thus shaving time is increased, and also it makes a user tired and inconvenient.

In addition, if the conventional rotation drum type electric razor is used for a long period, the protecting screen disposed at an outer side of the blade is deformed into a space between the adjacent blades by the user's external force, and the deformed screen is interfered with the blade rotated at a high speed, thereby deteriorating the shaving efficiency.

SUMMARY OF THE INVENTION

An embodiment of the present invention is directed to providing an insert type blade assembly of a rotation drum type electric razor, which has a plurality of blades of the blade assembly so that each blade is transversely fitted so as to a drum structure like a cylindrical body, and also each blade is shaft-coupled in a desired angle so as to minimize the space the adjacent blades and thus minimize the crush of the protective screen, thereby preventing the interference between the protective screen and the blade and also increasing the shaving efficiency.

Another embodiment of the present invention is directed to providing an insert type blade assembly of a rotation drum type electric razor, which can be simply assembled and disassembled upon damage of the blades which are transversely coupled to a rotational shaft, thereby facilely maintaining the electric razor and also reducing a maintaining cost by replacing only a necessary part of the whole components.

Yet another embodiment of the present invention is directed to providing an insert type blade assembly of a rotation drum type electric razor, which has a dual blade assembly in which one of them is disposed at a front or rear side of the other with a different height so as to provide a wide shaving area and excellent closely contacting ability with respect to a curve of the shaving portion, thereby increasing a shaving area and shaving efficiency and preventing the body hair from being dented between the blades after or during a shaving operation and also improving its durability.

To achieve the object of the present invention, the present invention provides an insert type blade assembly of a rotation drum type electric razor which includes a main body 10 that has an ON/OFF, switch 12 at a front surface thereof; a blade supporting means 20 that is coupled to an upper side of the main body 10 so as to receive a motor 22 driven by the ON/OFF switch 12; a power transmitting means 30 that is downwardly disposed at a side surface of the blade supporting means 20 and provided with a plurality of gears coupled to the motor 22 so as to transmit power; a plurality of blade assemblies 40 that is rotated at a high speed so as to cut body hair by the power transmitted from the power transmitting means 30 and respectively disposed at an upper portion of the blade supporting means 20; a trimmer assembly 50 that is coupled to a lower side of the blade supporting means 20 and provided with has a trimmer disposed at a rear side of the main body 10 so as to be reciprocated left and right by driving force transmitted from the power transmitting means 30; and a cover 60 that is coupled to an upper side of the main body 10 so as to cover the blade supporting means 20 and provided with a protective screen 62 to protect a shaving portion of a user from the blade assemblies 40, wherein the blade assembly 40 includes a rotational shaft 100 which is extended in a length direction; a plurality of rotational blade members 200 which are respectively formed into a cylindrical waterwheel shape having a plurality of blades 220 so as to be coupled to the rotational shaft 100 and in which a coupling protrusion 230 is formed at each end of the blades 220, and the blades 220 are fitted in turn to the rotational shaft 100 in the form of a zigzag shape; a fixing washer 300 which has a plurality of fixing holes 320 corresponding to the number of blades 220 so that the coupling protrusion 230 of the blades 220 of the rotational blade member 200 that is finally coupled to the rotational shaft 100 is inserted therein, and also has a shaft hole 310 which is shaft-coupled to an end of the rotational shaft 100.

Preferably, the plurality of rotational blade members 200 includes a rotational plate 210 in which a coupling hole 212 inserted onto the rotational shaft 100 is formed at a center portion thereof; a plurality of blades 220 which are integrally formed with the rotational plate 210, and respectively formed on a twisted angle tangentially contacted with an outer circumference of the rotational plate 210 so as to be bent at a right angle with respect to a surface of the rotational plate 210, thereby forming a three-dimensional waterwheel-shape; a coupling protrusion 230 which is provided at each end of the blades 220; and a blade coupling hole 240 which is formed at an outer circumference of the rotational plate 210 between the coupling protrusion 230 so as to be coupled with the coupling protrusions 230 of the adjacent blades 220.

Preferably, the coupling protrusions 230 inserted into the blade coupling holes 240 are coupled so as to be dislocated in an angle θ.

According to the present invention, the insert type blade assembly of the rotation drum type electric razor has a plurality of blades of the blade assembly so that each blade is transversely fitted to a drum structure like a cylindrical body, and also each blade is shaft-coupled in a desired angle so as to minimize the space the adjacent blades and thus minimize the crush of the protective screen, thereby preventing the interference between the protective screen and the blade and also increasing the shaving efficiency.

Further, the insert type blade assembly of the rotation drum type electric razor can be simply assembled and disassembled upon damage of the blades which are transversely coupled to a rotational shaft, thereby facilely maintaining the electric razor and also reducing a maintaining cost by replacing only a necessary part of the whole components.

In addition, the insert type blade assembly of the rotation drum type electric razor has a dual blade assembly in which one of them is disposed at a front or rear side of the other with a different height so as to provide a wide shaving area and excellent closely contacting ability with respect to a curve of the shaving portion, thereby increasing a shaving area and shaving efficiency and preventing the body hair from being dented between the blades after or during a shaving operation and also improving its durability.

DETAILED DESCRIPTION OF MAIN ELEMENTS

| | |
|---|---|
| 10: | main body |
| 12: | ON/OFF switch |
| 20: | blade supporting means |
| 21: | housing |
| 21a: | supporting protrusion |
| 23: | finish member |
| 24: | cover member |
| 25: | buffer member |
| 22: | motor |
| 30: | power transmitting means |
| 40: | blade assembly |
| 50: | trimmer assembly |
| 60: | cover |
| 62: | protective screen |
| 100: | rotational shaft |
| 200: | rotational blade member |
| 210: | rotational plate |
| 212: | coupling hole |
| 220: | blade |
| 230: | coupling protrusion |
| 240: | blade coupling hole |
| 300: | fixing washer |
| 310: | shaft hole |
| 320: | fixing hole |

DESCRIPTION OF SPECIFIC EMBODIMENTS

Hereinafter, the multi-channel surface plasmon resonance sensor using beam profile ellipsometry will be described fully with reference to the drawings.

Figure 1:
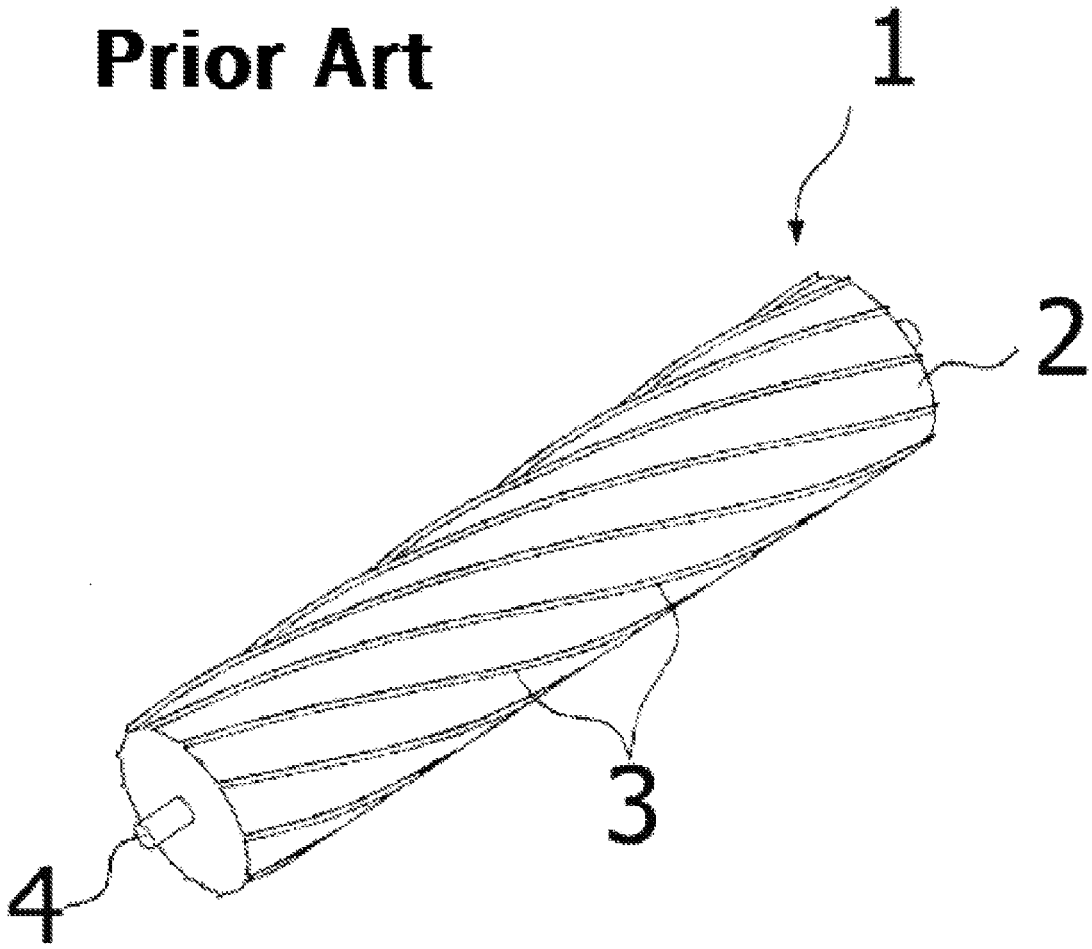
FIG. 1 is a perspective view of a conventional blade assembly.
Figure 2:
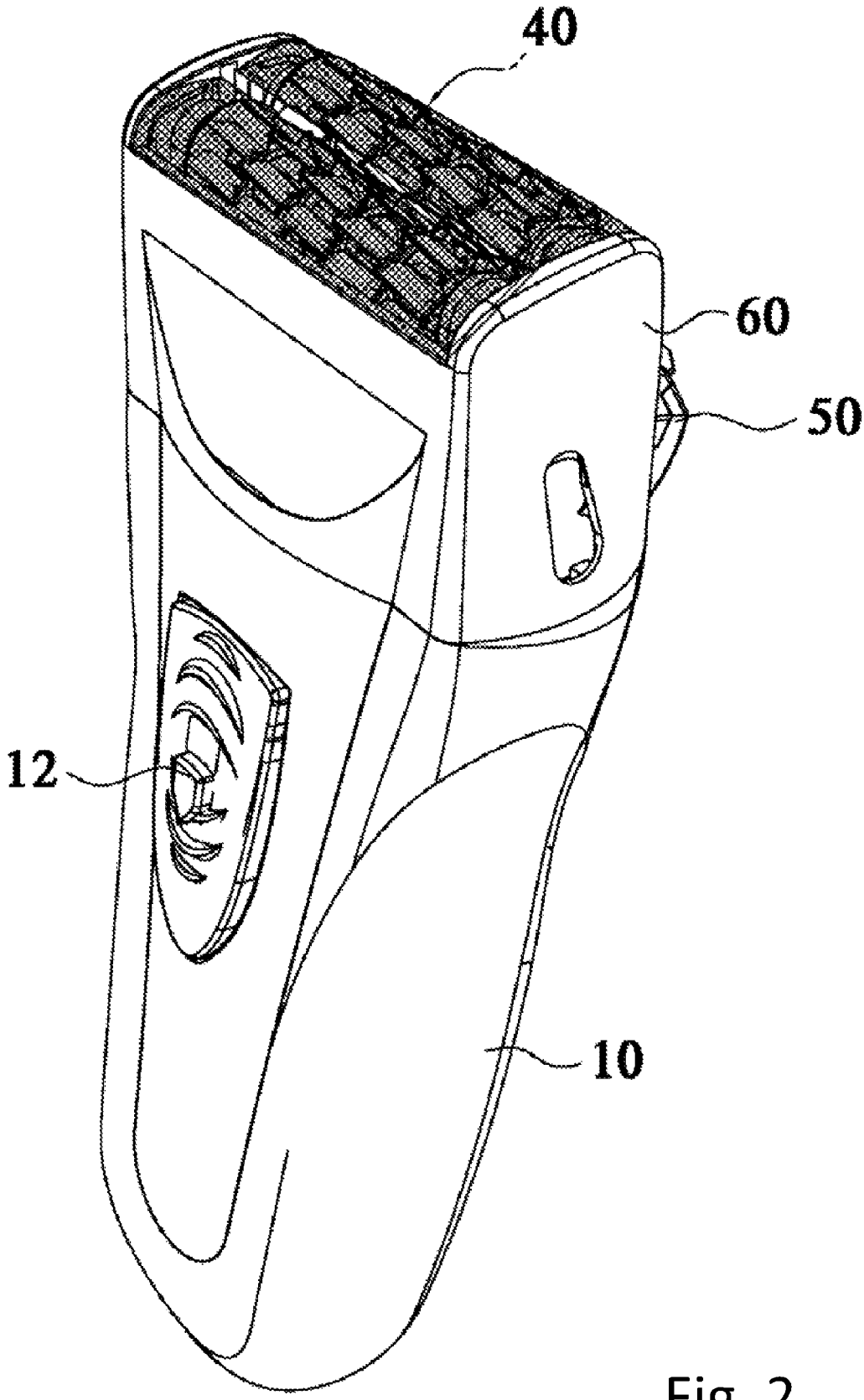
FIG. 2 is a perspective view of an insert type blade assembly of a rotation drum type electric razor according to the present invention.
Figure 3:
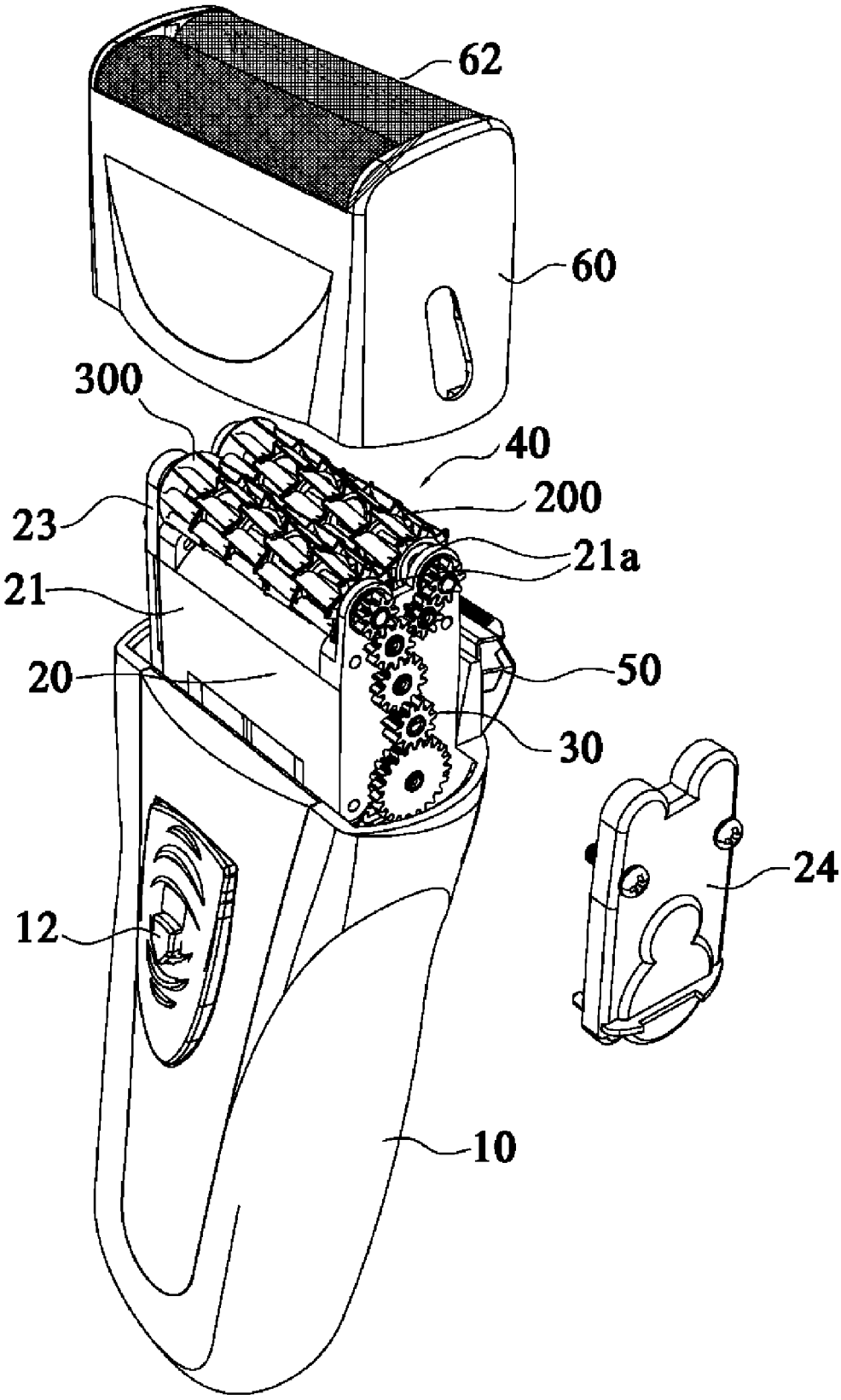
FIG. 3 is a partially exploded perspective view of the insert type blade assembly of the rotation drum type electric razor according to the present invention.
Figure 4:
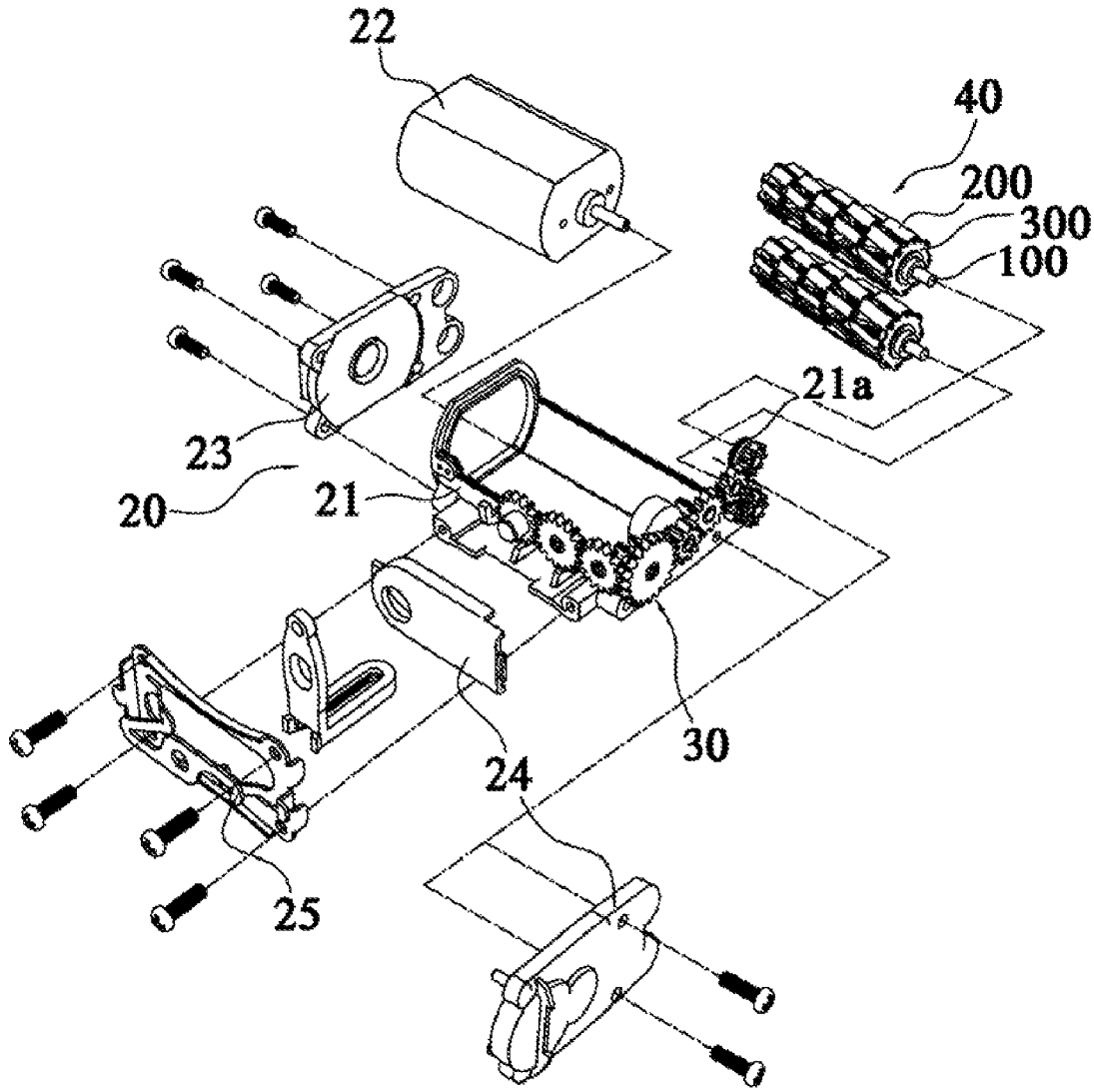
FIG. 4 is a perspective view of a main part of the insert type blade assembly of the rotation drum type electric razor according to the present invention.
Figure 5:
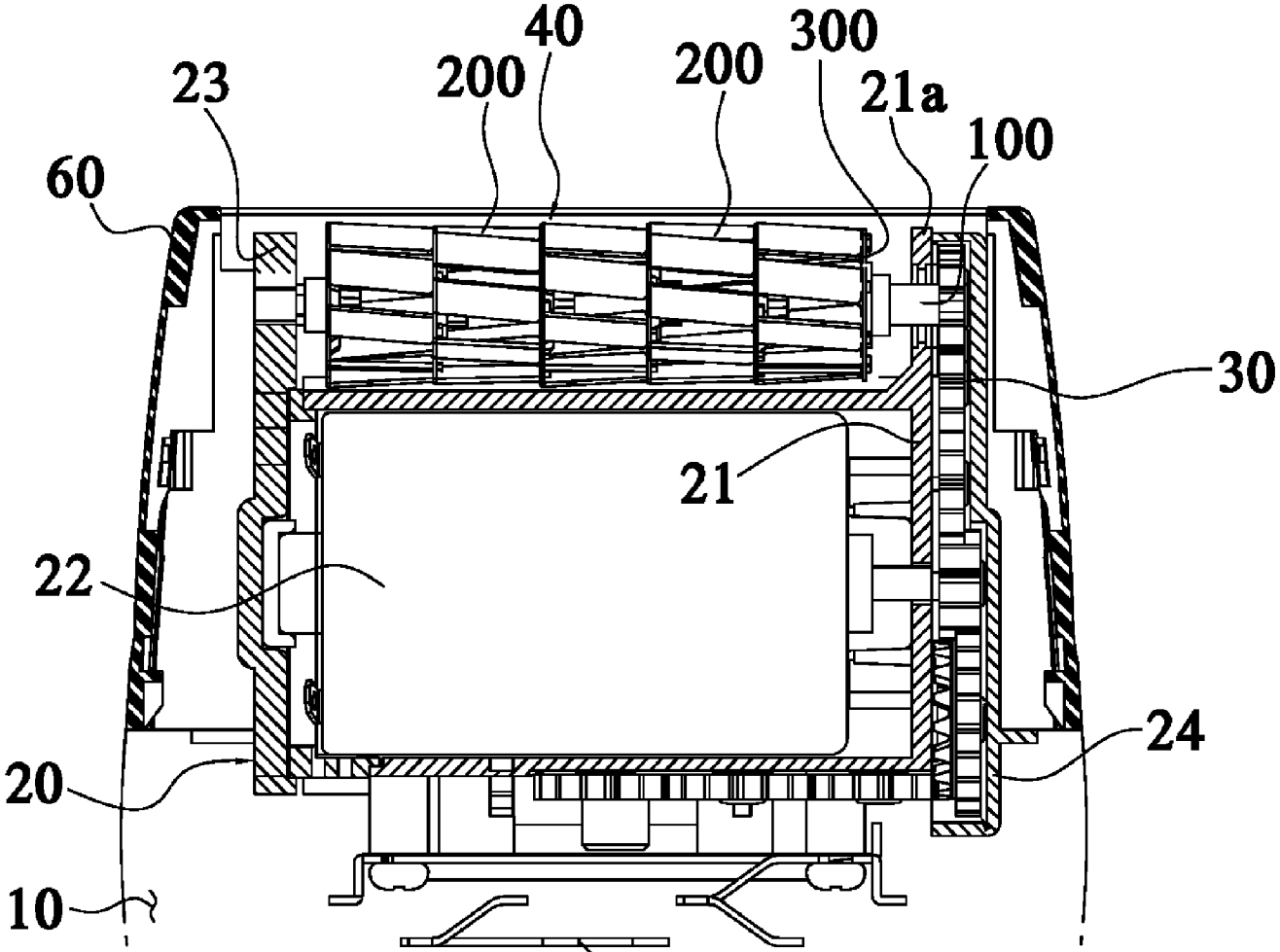
FIG. 5 is a cross-sectional view of the main part of the insert type blade assembly of the rotation drum type electric razor according to the present invention.
Figure 6:
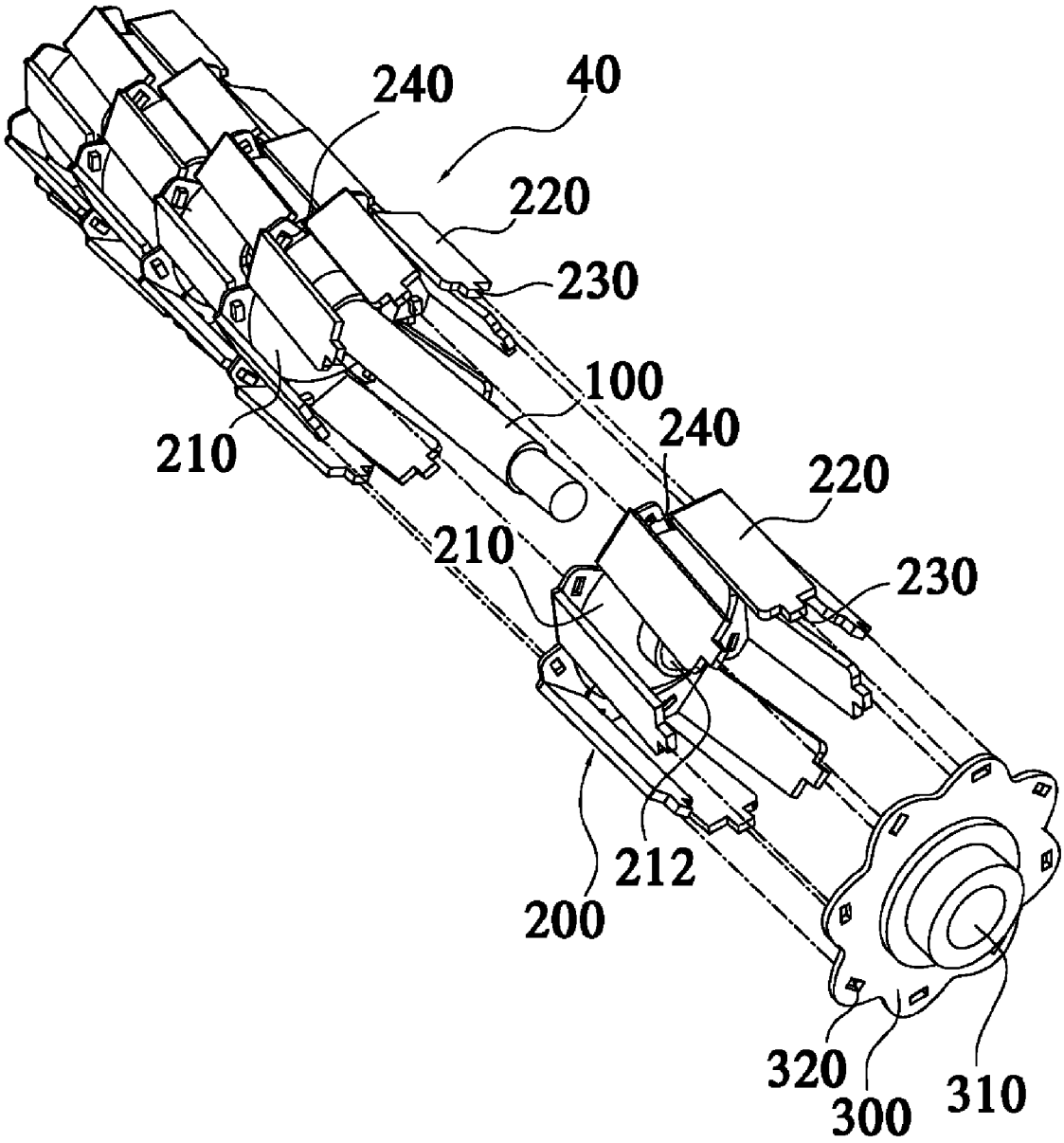
FIG. 6 is an exploded perspective view of the insert type blade assembly of the rotation drum type electric razor according to the present invention.
Figure 7:
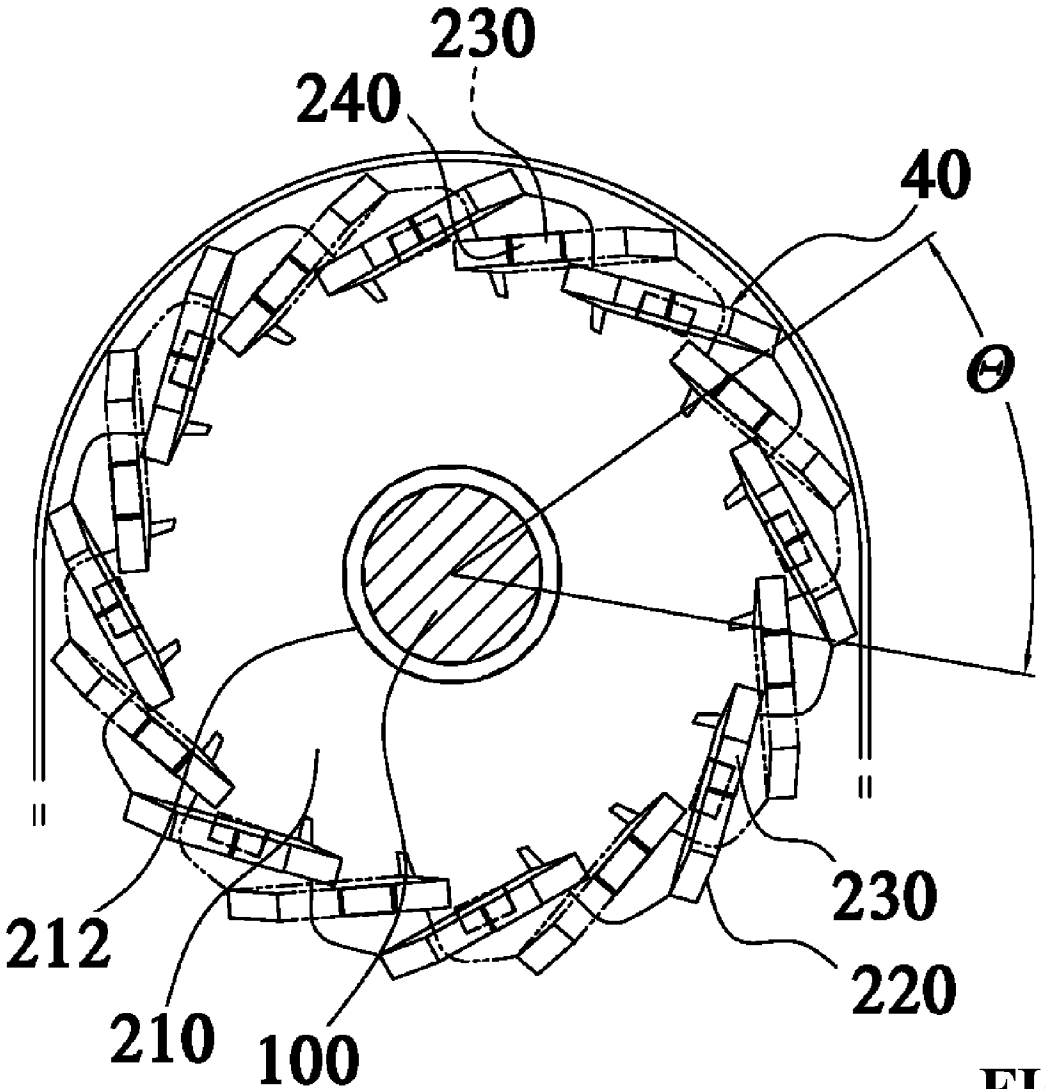
FIG. 7 is a side view of a fixing washer and an end of the insert type blade assembly of the rotation drum type electric razor according to the present invention.
Figure 8:
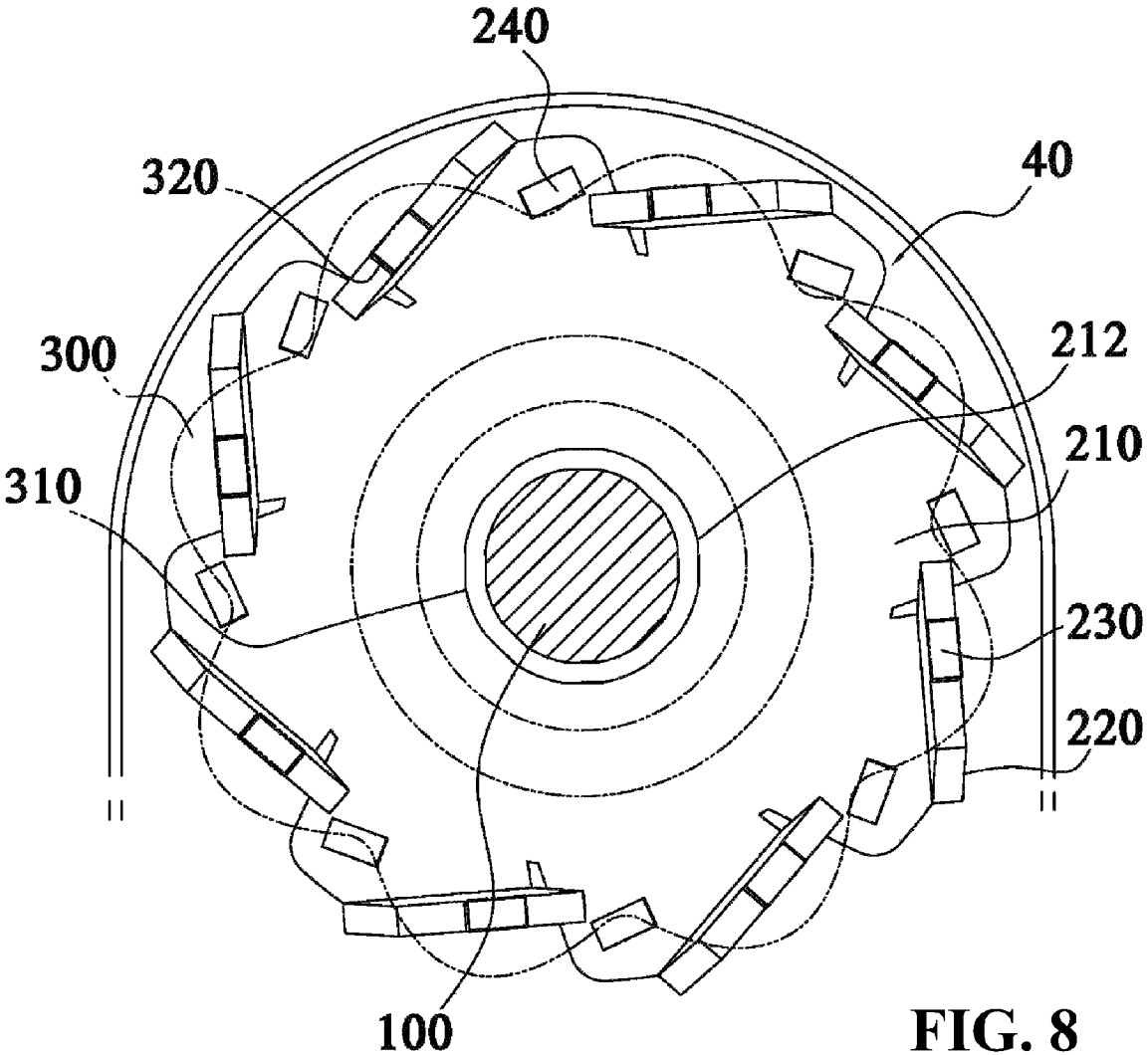
FIG. 8 is a side view of a coupled state between adjacent blades in the insert type blade assembly of the rotation drum type electric razor according to the present invention.

FIG. 2 is a perspective view of an insert type blade assembly of a rotation drum type electric razor according to the present invention, FIG. 3 is a partially exploded perspective view of the insert type blade assembly of the rotation drum type electric razor according to the present invention, FIG. 4 is a perspective view of a main part of the insert type blade assembly of the rotation drum type electric razor according to the present invention, FIG. 5 is a cross-sectional view of the main part of the insert type blade assembly of the rotation drum type electric razor according to the present invention, FIG. 6 is an exploded perspective view of the insert type blade assembly of the rotation drum type electric razor according to the present invention, FIG. 7 is a side view of a fixing washer and an end of the insert type blade assembly of the rotation drum type electric razor according to the present invention, and FIG. 8 is a side view of a coupled state between adjacent blades in the insert type blade assembly of the rotation drum type electric razor according to the present invention.

In an insert type blade assembly of a rotation drum type electric razor according to the present invention, it is possible to increase the closely contacting ability with a shaving portion and also provide a wide shaving area, when carrying out a shaving operation, and it is facile to maintain the blade assembly because it can be easily assembled and disassembled, thereby increasing its durability, and also it is possible to minimize a space between adjacent blades, thereby minimizing a protective screen contacted with the shaving portion from being dented into the space between the adjacent blades. As shown in FIGS. 2 and 3, the insert type blade assembly of the rotation drum type electric razor according to the present invention includes a main body 10, a blade supporting means 20, a power transmitting means 30, multiple blade assemblies 40, a trimmer assembly 50, and a cover 60.

Preferably, the main body 10 has a curved-shape so as to provide a smooth movement of a user's wrist upon a shaving operation. An ON/OFF switch 12 is disposed at a front surface of the main body 10 so as to drive a motor 22 installed in the blade supporting means 20, and also a typical construction like a battery for driving the razor is provided in the main body 10.

The blade supporting means 20, in which the insert type blade assembly 40 and the trimmer assembly 50 to be described later are drivably installed, is coupled to an upper side of the main body 10. Herein, the motor 22 driven by the ON/OFF switch 12 is installed in the blade supporting means 20, and the power transmitting means 30 to be described later is downwardly disposed at a side surface of the blade supporting means 20 so as to drive the insert type blade assembly 40 and the trimmer assembly 50. As shown in FIGS. 4 and 5, the blade supporting means 20 includes a housing 21, a supporting protrusion 21*a*, a finish member 23, a cover member 24, and a buffer member 25.

The housing 21 is formed into a rectangular enclosure of which parts are opened, and the motor 22 is inserted therein through the opened sides. One ends of the multiple blade assemblies 40 to be described later are coupled to the supporting protrusion 21*a* so as to receive power from the power transmitting means 30 and rotate at a high speed. As shown in FIGS. 4 and 5, the supporting protrusion 21*a* is protruded at an upper side of the housing 21. Herein, each end of the multiple blade assemblies 40 is shaft-coupled to the supporting protrusion 21*a*. When the insert type blade assemblies 40 are coupled to the supporting protrusion 21*a*, it is preferable that the insert type blade assemblies 40 are respectively disposed to have a different height, thereby being corresponding to a curve of a user's shaving portion.

The finish member 23 is disposed to close a part of the opened sides of the housing 21 so that the motor 22 is fixed to the housing 21. Other ends of the insert type blade assemblies 40 are shaft-coupled to an upper side of the finish member 23. The cover member 24 is provided to cover the power transmitting means 30 installed in the housing 21 and thus prevent a plurality of gears of the power transmitting means 30 from being exposed to an outside, thereby preventing interference in rotation of the gears.

The buffer member 25 functions to buffer vibrations of the insert type blade assemblies 40 and the trimmer assembly 50 and also to prevent a user's hand from being shaken, whereby the user can facilely perform a shaving operation. The buffer member 25 is fastened to a lower side of the housing 21 with a bolt.

The power transmitting means 30 includes a plurality of gears which are downwardly disposed at the side surface of the housing 21 so as to transmit the power from the motor 22 to the insert type blade assemblies 40 and the trimmer assembly 50.

Since the trimmer assembly 50 and the cover 60 have typical constructions, their detailed descriptions will be omitted.

In other words, the insert type blade assemblies 40 is coupled to the blade supporting means 20 disposed at the upper side of the main body 10 so as to be rotated by the power transmitted from the motor 22 through the power transmitting means 30. Since the insert type blade assemblies 40 installed in an insertion method can be simply assembled and disassembled, as described above, it is facile to replace only part of components upon damage of some components, thereby increasing durability and also reducing a maintaining cost. As described in FIG. 6, the insert type blade assemblies 40 includes a rotational shaft 100, a rotational blade member 200, and a fixing washer 300.

The rotational shaft 100 is extended in a length direction, and one end thereof is rotatably coupled to the supporting protrusion 21*a* of the housing 21, and the other end is coupled to the finish member 23 so as to be rotated at a high speed. In other words, the one end of the rotational shaft 100 coupled to the supporting protrusion 21*a* is coupled to the power transmitting means 30 so as to be rotated by rotational force transmitted from the motor 22 through the power transmitting means 30.

Herein, a stepped portion is formed at both ends of the rotational shaft 100. In order to prevent the rotational blade member 200 from being idled on the rotational shaft 100 when the rotational blade member 200 is inserted onto a center portion of the rotational shaft 100, it is preferable that the rotational shaft 100 may be formed into a square, pentagonal and hexagonal pole shape.

The rotational blade member 200 has a cylindrical waterwheel shape, and a plurality of blades 220 are axially disposed on a circumference of the rotational shaft 100 so as to be shaft-coupled to the rotational shaft 100, and the blades are arranged in the form of a zigzag shape in an angle θ. As shown in FIGS. 6 and 7, the rotational blade member 200 includes a rotational plate 210, a plurality of blades 220, a coupling protrusion 230, and a plurality of blade coupling holes 240.

The rotational plate 210 is formed into a circular plate in which a coupling hole 212 inserted onto the rotational shaft 100 is formed at a center portion thereof. The coupling hole 212 may have a different shape corresponding to the shape of the center portion of the rotational shaft 100.

The plurality of blades 220 for cutting the body hair on the user's shaving portion are integrally formed with the rotational plate 210. The blades 220 are formed on a twisted angle tangentially contacted with an outer circumference of the rotational plate 210 so as to be bent at a right angle with respect to a surface of the rotational plate 210, thereby forming a three-dimensional waterwheel-shape.

The coupling protrusion 230 is formed at each end of the blades 220 so as to be inserted into the blade coupling hole 240. The plurality of coupling protrusions 230 are inserted into the blade coupling holes 240 of the adjacent blades 220 so as to be axially stacked in a zigzag shape. Further, the coupling protrusion 230 formed at each end of the blades 220 of an outermost rotational member 200 is inserted into a fixing hole 320 of the fixing washer 300.

The plurality of blade coupling holes 240 are formed at an outer circumference of the rotational plate 210 between the coupling protrusion 230 so as to be coupled with the coupling protrusions 230 of the adjacent blades 220. Herein, the coupling protrusions 230 inserted into the blade coupling holes 240 are coupled so as to be dislocated in an angle θ so that the adjacent rotational members 200 are also dislocated from each other in the angle θ. Therefore, a space between the adjacent blades 220 is minimized, and thus an interference of a protective screen is also minimized, thereby increasing the shaving efficiency.

As shown in FIGS. 6 and 8, the fixing washer 300 has the plurality of fixing holes 320 corresponding to the number of blades 220 so that the coupling protrusion 230 formed at each end of the blades 220 of the final rotational blade member 200 is inserted therein. The fixing washer 300 is formed with a shaft hole 310 in which the end of the rotational shaft 100 is inserted.

According to the insert type blade assembly of the rotation drum type electric razor according to the present invention, as described above, when each rotational blade member 200 is coupled to other adjacent rotational blade member 200 after the plurality of rotational blade members 200 are shaft-coupled to the rotational shaft 100, it is facile to perform an assembling operation by using the coupling protrusion 230 and the blade coupling hole 240, and further, since the adjacent rotational blade members 200 are coupled to each other in the angle θ, the blades can be arranged spirally. Furthermore, since the space between the blades 220 is minimized, it is possible to prevent the protective screen from being crushed by external force, thereby preventing the interference of the protective screen.

Accordingly, when using the electric razor during a long time period, it is possible to prevent a rotational interference of the insert type blade assembly 40 due to deformation of the protective screen, thereby increasing the shaving efficiency. In addition, since the rotational blade member 200 is shaft-coupled to the rotational shaft 100, and the multiple rotational blade members 200 are easily assembled in the insertion method so as to be integrally rotated, it is possible to facilely perform the assembling and disassembling operations upon replacement of damaged components.

In addition, since the blade 220 is formed in an optimal cutting angle having a desired twisted angle by press-cutting and shape-forming processes, it is possible to facilely produce components thereof. And since the blades may be spirally arranged by the insertion method, it is possible to provide high cutting force and also prevent the body hair from being caught between the blades.

While the present invention has been described with respect to the specific embodiments, it will be apparent to those skilled in the art that various changes and modifications may be made without departing from the spirit and scope of the invention as defined in the following claims.

What is claimed is:

1. A rotation drum type electric razor which comprises a main body (10) that has an ON/OFF switch (12) at a front surface thereof; a blade supporting means (20) that is coupled to an upper side of the main body (10) so as to receive a motor (22) driven by the ON/OFF switch (12); a power transmitting means (30) that is downwardly disposed at a side surface of the blade supporting means (20) and provided with a plurality of gears coupled to the motor (22) so as to transmit power; a plurality of blade assemblies (40) that is rotated at a high speed so as to cut body hair by the power transmitted from the power transmitting means (30) and respectively disposed at an upper portion of the blade supporting means (20); a trimmer assembly (50) that is coupled to a lower side of the blade supporting means (20) and provided with a trimmer disposed at a rear side of the main body (10) so as to be reciprocated left and right by driving force transmitted from the power transmitting means (30); and a cover (60) that is coupled to the upper side of the main body (10) so as to cover the blade supporting means (20) and provided with a protective screen (62) to protect a shaving portion of a user from the blade assemblies (40), wherein each of the blade assemblies (40) comprises a rotational shaft (100) which is extended in a length direction; a plurality of rotational blade members (200), each formed into a cylindrical waterwheel shape and having a plurality of blades (220) so as to be coupled to the rotational shaft (100) and in which a coupling protrusion (230) is formed at each end of the blades (220), and the blades (220) are fitted in turn to the rotational shaft (100) in the form of a zigzag shape;

a fixing washer (300) which has a plurality of fixing holes (320) corresponding to the number of the blades (220) so that the coupling protrusion (230) of the blades (220) of the rotational blade member (200) that is finally coupled to the rotational shaft (100) is inserted therein, and also has a shaft hole (310) which is shaft-coupled to an end of the rotational shaft (100).

2. The rotation drum type electric razor of claim 1, wherein each of the plurality of rotational blade members (200) comprises:

a rotational plate (210) in which a coupling hole (212) inserted onto the rotational shaft (100) is formed at a center portion thereof;

the plurality of blades (220) which are integrally formed with the rotational plate (210), and respectively formed on a twisted angle tangentially contacted with an outer circumference of the rotational plate (210) so as to be bent at a right angle with respect to a surface of the rotational plate (210), thereby forming a three-dimensional waterwheel-shape;

a coupling protrusion (230) which are provided at each end of the blades (220); and a blade coupling hole (240) which are formed at an outer circumference of the rotational plate (210) between the coupling protrusion (230) so as to be coupled with the coupling protrusions (230) of the adjacent blades (220).

3. The rotation drum type electric razor of claim 2, wherein the coupling protrusions (230) inserted into the blade coupling holes (240) are coupled so as to be dislocated in an angle θ.

* * * * *